United States Patent [19]

Maninger et al.

[11] Patent Number: 4,952,186

[45] Date of Patent: Aug. 28, 1990

[54] METHOD OF MAKING A COLOR PICTURE TUBE ELECTRON GUN WITH REDUCED CONVERGENCE DRIFT

[75] Inventors: Loren L. Maninger; Bruce G. Marks, both of Lancaster, Pa.

[73] Assignee: RCA Licensing Corporation, Princeton, N.J.

[21] Appl. No.: 427,275

[22] Filed: Oct. 24, 1989

[51] Int. Cl.[5] ..... H01J 9/00

[52] U.S. Cl. ..... 445/36; 445/3

[58] Field of Search ..... 445/36, 3

[56] References Cited

U.S. PATENT DOCUMENTS

| | | | |
|---|---|---|---|
| 4,138,624 | 2/1979 | Srowig | 313/417 |
| 4,460,845 | 7/1984 | Brown et al. | 313/417 |
| 4,492,894 | 1/1985 | Reule et al. | 313/417 |
| 4,546,287 | 10/1985 | Collins et al. | 313/414 |
| 4,631,442 | 12/1986 | Reule et al. | 313/414 |
| 4,697,120 | 9/1987 | Alig et al. | 313/412 |
| 4,772,826 | 9/1988 | Bloom et al. | 313/414 |

FOREIGN PATENT DOCUMENTS 1108683 9/1981 Canada .

*Primary Examiner*—Kenneth J. Ramsey

*Attorney, Agent, or Firm*—Joseph S. Tripoli; Dennis H. Irlbeck

[57] ABSTRACT

An improved method of making a color picture tube electron gun includes the selection and assembly of a plurality of cathodes and a plurality of electrodes longitudinally spaced from the cathodes. The improvement comprises at least three additional steps. First, the amount and direction of electron beam misconvergence at the tube screen, as caused by the thermal expansion of each individual electrode during electron gun warmup, is determined. A first group of electrodes will cause misconvergence in a first direction, and a second group of electrodes will cause misconvergence in a second direction. Second, the individual contributions of the electrodes to misconvergence during tube warmup are summed. The net effect of thermal expansion of the entire electron gun is a misconvergence in the first direction. Third, at least one of the electrodes in the first group of electrodes is formed from a material having a lower coefficient of thermal expansion than the coefficient of thermal expansion used in the first step of determining misconvergence caused by the thermal expansion of each individual electrode.

1 Claim, 10 Drawing Sheets

12
18
16
10
P
24
14
28
A
A
22
100
26
30
P
20

METHOD OF MAKING A COLOR PICTURE TUBE ELECTRON GUN WITH REDUCED CONVERGENCE DRIFT

This invention relates to color picture tubes having multibeam electron guns and particularly, to an improved method of making such guns having reduced convergence drift of the electron beams during tube warmup.

BACKGROUND OF THE INVENTION

The most common multibeam electron gun presently used in color picture tubes is the inline electron gun. An inline electron gun is one designed to generate or initiate preferably three electron beams in a common plane and direct those beams along convergent paths in that plane, to a point or small area of convergence at the tube screen.

Most inline electron guns attain static convergence of the undeflected electron beams by slightly distorting the focus fields at the outer beams, so that the outer beams are deflected toward the center beam to effect convergence of the beams at the screen. One means of distorting the focus fields is to offset one aperture in a focus electrode from its associated aperture in a facing focus electrode. A given static convergence at the screen of a tube is established by a particular combination of aperture offsets throughout the gun and beam position in the main lens. A problem, encountered in color picture tubes having built-in static convergence, is convergence drift during tube warm-up. Convergence drift is caused by a change of beam position in the main lens due to a relative change of horizontal aperture positions of all the electrodes throughout the electron gun. The relative aperture motion is caused by different thermal expansions of the different grids due to a temperature gradient from the cathode to the main lens.

The convergence drift problem has been approached previously by tailoring the coefficient of expansion of each electrode, to match the thermal gradient and keep the relative horizontal positions of all apertures throughout the gun constant. Such a modified electron gun is disclosed in U.S. Pat. No. 4,631,442, issued to Reule et al. on Dec. 23, 1986.

However, it was determined by the present inventors that simply matching the coefficients of expansion of the electrodes to the thermal gradient in an electron gun does not always provide the desired reduction in convergence drift.

SUMMARY OF THE INVENTION

The present invention provides an improvement in a method of making a color picture tube electron gun that includes the selection and assembly of a plurality of cathodes and a plurality of electrodes longitudinally spaced from the cathodes. The improvement comprises at least three additional steps. First, the amount and direction of electron beam misconvergence at the tube screen, as caused by the thermal expansion of each individual electrode during electron gun warmup, is determined. A first group of electrodes will cause misconvergence in a first direction, and a second group of electrodes will cause misconvergence in a second direction. Second, the individual contributions of the electrodes to misconvergence during tube warmup are summed. The net effect of thermal expansion of the entire electron gun is a misconvergence in the first direction. Third, at least one of the electrodes in the first group of electrodes is formed from a material having a lower coefficient of thermal expansion than the coefficient of thermal expansion used in the first step of determining misconvergence caused by the thermal expansion of each individual electrode.

The more detailed analysis of the gun structure can be used to attain an even greater reduction in convergence drift.

DETAILED DESCRIPTION OF THE PREFERRED EMBODIMENT

Figure 1:
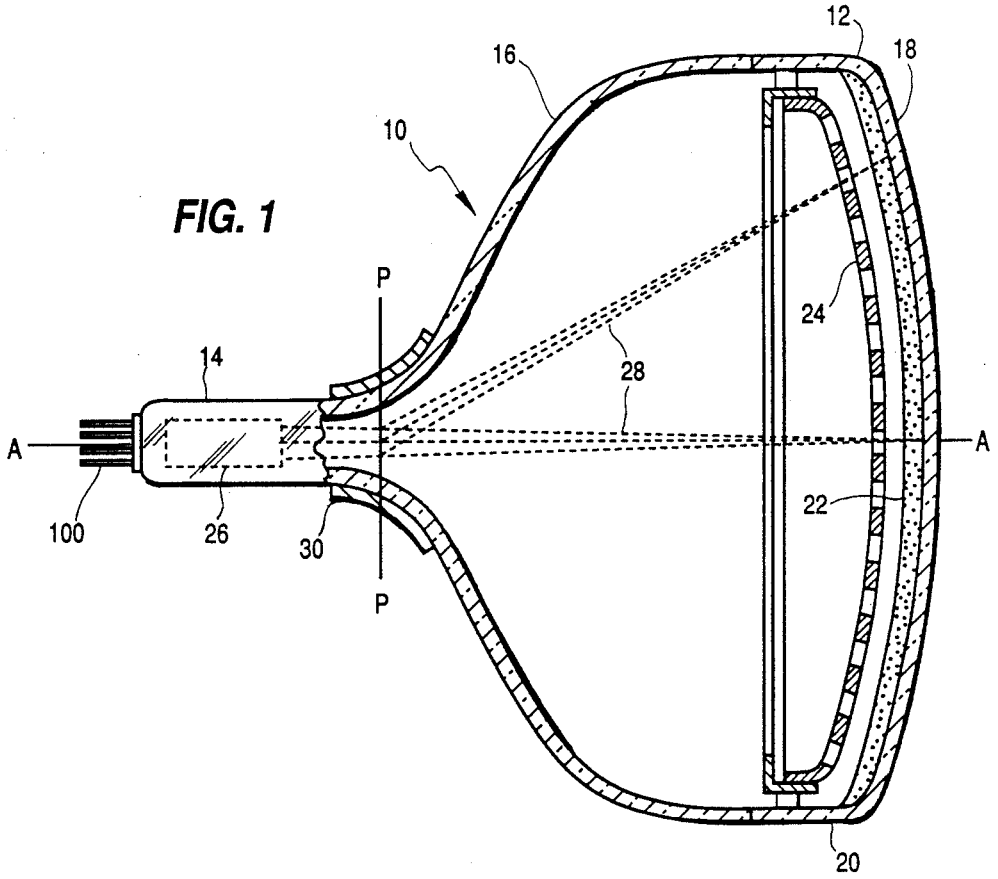
FIG. 1 is a plan view, partly in axial section, of a shadow mask color picture tube embodying the invention.

FIG. 1 is a plan view of a rectangular color picture tube 10 having a glass envelope comprising a rectangular faceplate panel or cap 12 and a tubular neck 14 connected by a rectangular funnel 16. The panel comprises a viewing faceplate 18 and a peripheral flange or sidewall 20 which is sealed to the funnel 16. A three-color phosphor screen 22 is carried by the inner surface of the faceplate 18. The screen is preferably a line screen with the phosphor lines extending substantially perpendicular to the high frequency raster line scan of the tube (normal to the plane of FIG. 1). A multi-apertured color-selection electrode or shadow mask 24 is removably mounted in predetermined spaced relation to the screen 22. An improved inline electron gun 26, shown schematically by dotted lines in FIG. 1, is centrally mounted within the neck 14 to generate and direct three electron beams 28 along coplanar convergent paths through the mask 24 to the screen 22.

The tube of FIG. 1 is designed to be used with an external magnetic deflection yoke, such as the self-converging yoke 30 shown surrounding the neck 14 and funnel 12 in the neighborhood of their junction. When activated, the yoke 30 subjects the three beams 28 to vertical and horizontal magnetic fields which cause the beams to scan horizontally and vertically, respectively, in a rectangular raster over the screen 22. The initial plane of deflection (at zero deflection) is shown by the line P-P in FIG. 1 at about the middle of the yoke 30. Because of fringe fields, the zone of deflection of the tube extends axially, from the yoke 30 into the region of the electron gun 26. For simplicity, the actual curvature of the deflected beam paths in the deflection zone is not shown in FIG. 1.

Figure 2:
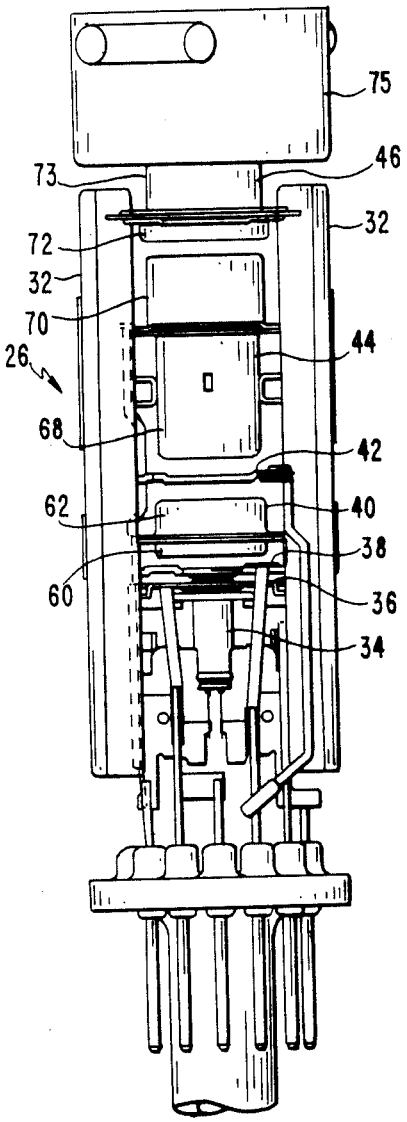
FIG. 2 is a side view of the electron gun shown in dashed lines in FIG. 1.
Figure 3:
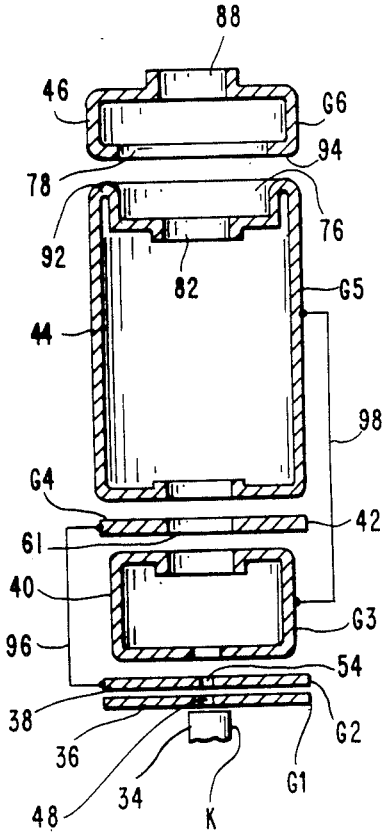
FIG. 3 is an axial section view of a simplified version of the electron gun shown in FIG. 2.

The details of the electron gun 26 are shown in FIGS. 2 and 3. The electron gun comprises two glass supports rods 32 on which various electrodes are mounted. These electrodes include three equally spaced coplanar cathodes 34 (one for each beam), a G1 grid electrode 36, a G2 grid electrode 38, a G3 electrode 40, a G4 electrode 42, a G5 electrode 44, and a G6 electrode 46, spaced along the glass rods 32 in the order named. All of the post-cathode electrodes have three inline apertures therein to permit passage of three coplanar electron beams. The G1 grid electrode 36 and the G2 grid electrode 38 are parallel flat plates that can include embossings therein, e.g., for added strength. Three inline apertures 48 (one shown) are located in the G1 grid electrode 36, and three apertures 54 (one shown) are located in the G2 grid electrode 38. The G3 electrode 40 is formed by two cup-shaped elements 60 and 62, each having apertured bottoms. The apertured bottom of the element 60 faces the G2 grid electrode 38, and the open end of the element 60 is attached to the open end of the element 62. The G4 electrode 42 is a plate having three apertures 61 (one shown) therein. The G5 electrode 44 is formed with two cup-shaped elements 68 and 70. The closed ends of the elements 68 and 70 include each three apertures, and the open ends of the elements 68 and 70 are connected. The G6 electrode 46 also includes two cup-shaped elements 72 and 73 having apertured bottoms. A shield cup 75 is attached to the outside bottom of the element 73.

The facing closed ends of the G5 electrode 44 and the G6 electrode 46, as shown in FIG. 3, have large recesses 76 and 78, respectively, therein. The recesses 76 and 78 set back a portion of the closed end of the G5 electrode 44 that contains three apertures 82 (one shown) from a portion of the closed end of the G6 electrode 46 that contains three apertures 88 (one shown). The remaining portions of the closed ends of the G5 electrode 44 and the G6 electrode 46 form rims 92 and 94, respectively, that extend peripherally around the recesses 76 and 78. The rims 92 and 94 are the closest portions of the two electrodes 44 and 46 to each other. The configuration of the recess 78 in the G6 electrode 46 is different from that of the recess 76 in the G5 electrode 44. The recess 78 is narrower at the center aperture than at the side apertures, whereas the recess 76 is uniform in width at the three apertures therein.

The G4 electrode 42 is electrically connected by a lead 96 to the G2 electrode 38, and the G3 electrode 40 is electrically connected by a lead 98 to the G5 electrode 44, as shown in FIG. 3. Separate leads (not shown) connect the G3 electrode 40, the G2 electrode 38, the G1 electrode 36, the cathodes 34 and the cathode heaters to a base 100 (shown in FIG. 1) of the tube 10, so that these components can be electrically activated. Electrical activation of the G6 electrode 46 is obtained by a contact between the shield cup 75 and an internal conductive coating in the tube which is electrically connected to an anode button extending through the funnel 16. (The coating and anode button are not shown.)

In the electron gun 26, the cathodes 34, the G1 electrode 36 and the G2 electrode 38 comprise the beam-forming region of the gun. During tube operation, modulated control voltages are applied to the cathodes 34, the G1 electrode 36 is electrically grounded, and a relatively low positive voltage (e.g., 800 to 1100 volts) is applied to the G2 electrode 38. The G3 electrode 40, the G4 electrode 42, and the facing portion of the G5 electrode 44 comprise a prefocusing lens portion of the electron gun 26. During tube operation, a focus voltage is applied to both the G3 electrode 40 and to the G5 electrode 44. The facing portions of the G5 electrode 44 and the G6 electrode 46 comprise the main focus lens of the electron gun 26. During tube operation, an anode voltage is applied to the G6 electrode 46, so that a bipotential focus lens is formed between the G5 and G6 electrodes.

Some typical dimensions for the electron gun 26 of FIG. 2 are presented in the following table.

TABLE

| | |
|---|---|
| External diameter of tube neck | 29.00 mm. |
| Internal diameter of tube neck | 24.00 mm. |
| Spacing between G1 and G2 electrodes | 0.18 mm. |
| Spacing between G2 and G3 electrodes | 1.19 mm. |
| Spacing between G3 and G4 electrodes | 1.27 mm. |
| Spacing between G4 and G5 electrodes | 1.27 mm. |
| Spacing between G5 and G6 electrodes | 1.27 mm. |
| Center-to-Center spacing between adjacent apertues in G5 electrode | 5.08 mm. |
| Diameter of Apertures in G5 and G6 electrodes | 4.06 mm. |
| Depth of recess in G5 electrode | 2.03 mm. |
| Thickness of G1 electrode | 0.10 mm. |
| Thickness of G2 electrode | 0.25 to 0.50 mm. |
| Thickness of G3 electrode | 7 mm. |
| Length of G4 electrode | 0.51 to 1.78 mm. |
| Length of G5 electrode | 17.22 mm. |
| Focus voltage | 7.8 to 9.5 kV |
| Anode voltage | 25 kV |

For the above-described electron gun 26, the G1 electrode 36, the G2 electrode 38 and the G4 electrode 42 are constructed of a material or materials having lower coefficients of thermal expansion than do the materials used to construct the other electrodes. Preferably, the G1 electrode 36, the G2 electrode 38 and the G4 electrode 42 are made from 430 stainless steel, which is a magnetically permeable material. The bottom portion or G2-facing side of the G3 electrode 40 is made from a 52% nickel alloy which is also magnetically permeable. The top portion of the G3 electrode 40, the G5 electrode 44 and the G6 electrode 46 are made from 305 stainless steel, which is nonmagnetic. The purpose and results of using these materials of different coefficients of thermal expansion are discussed below.

Design Method

Figure 4:
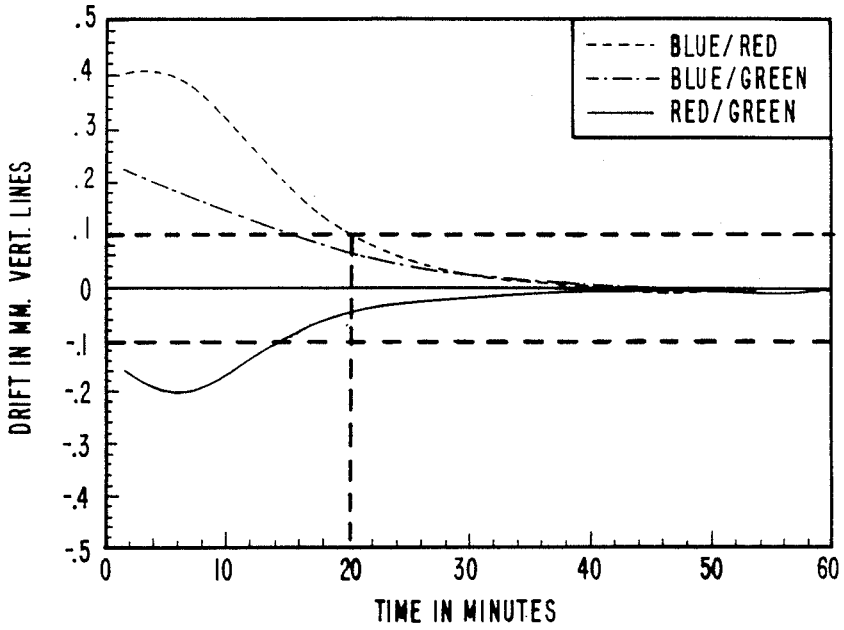
FIG. 4 is a graph showing convergence drift versus time of a standard unmodified electron gun of the type shown in FIG. 2.

The convergence drift of a standard unmodified electron gun of the same type as disclosed in FIG. 2 is shown in FIG. 4. The drift between the blue and red beams does not decrease to less than 0.1 mm until about 20 minutes. First, it is desirable to reduce the time that it takes for the convergence drift to decrease below 0.1 mm, but preferably, it is desirable to design an electron gun wherein the convergence drift never exceeds 0.1 mm.

The improved electron gun was designed by analyzing the motion of each electrode in the gun during tube warmup and then by determining the sensitivity of electron beam motion to the horizontal motion of the apertures in each electrode. Once this sensitivity was established, it was then determined how to alter the aperture motion of selected electrodes, to reduce convergence drift, through the use of different thermal expansion materials.

In doing the analysis, a computer program was used that simulated the electron beam trajectories. Following the analysis, actual tubes were built and tested to verify the analytical results.

Electron Gun Analysis

Figure 5:
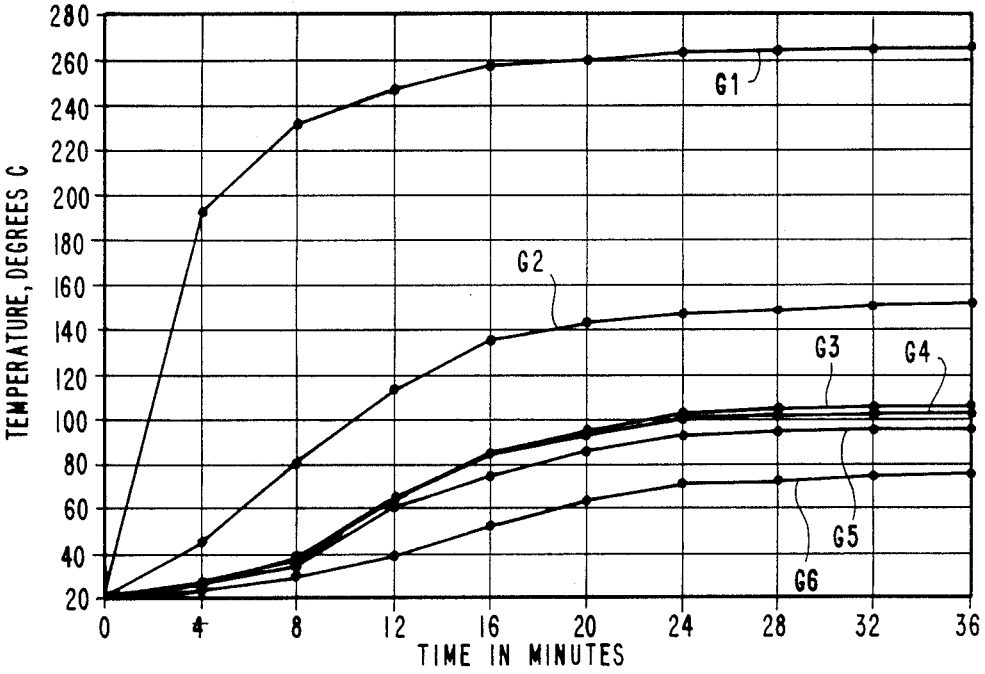
FIG. 5 is a graph of electrode temperature versus time during tube warmup.
Figure 6:
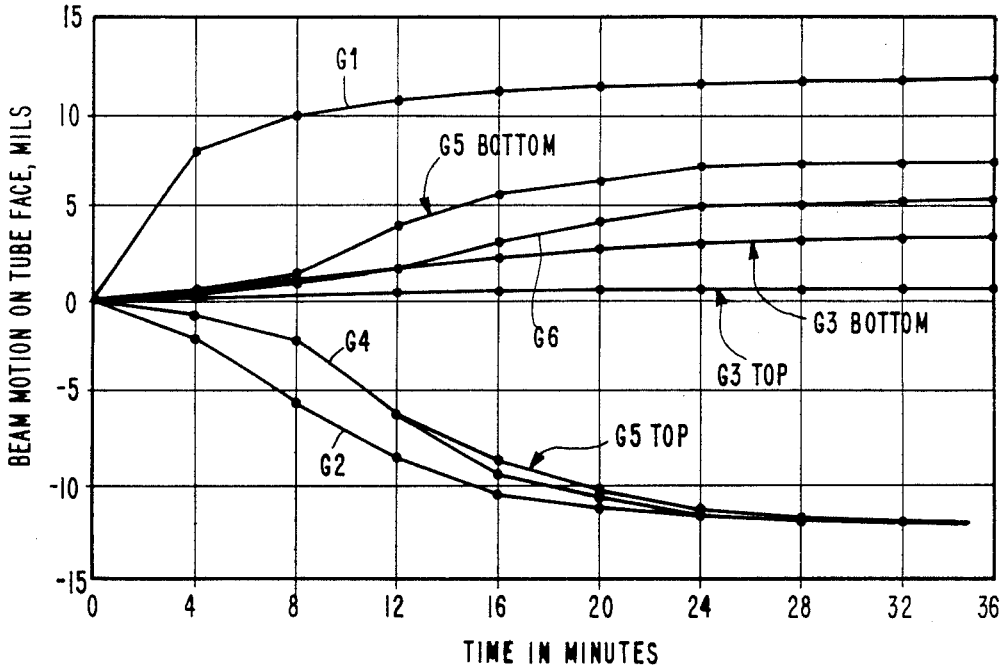
FIG. 6 is a graph of electron beam motion versus time for each electrode of the electron gun of FIG. 2.
Figure 7:
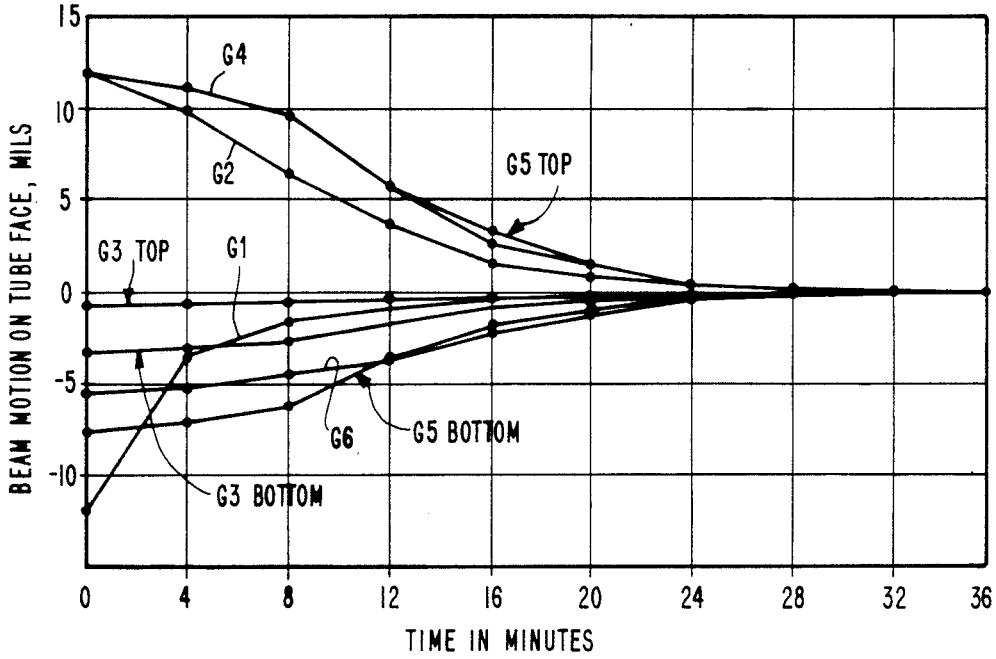
FIG. 7 is a graph, similar to the graph of FIG. 6, with the curves normalized to converge at the end of the tube warmup time.
Figure 8:
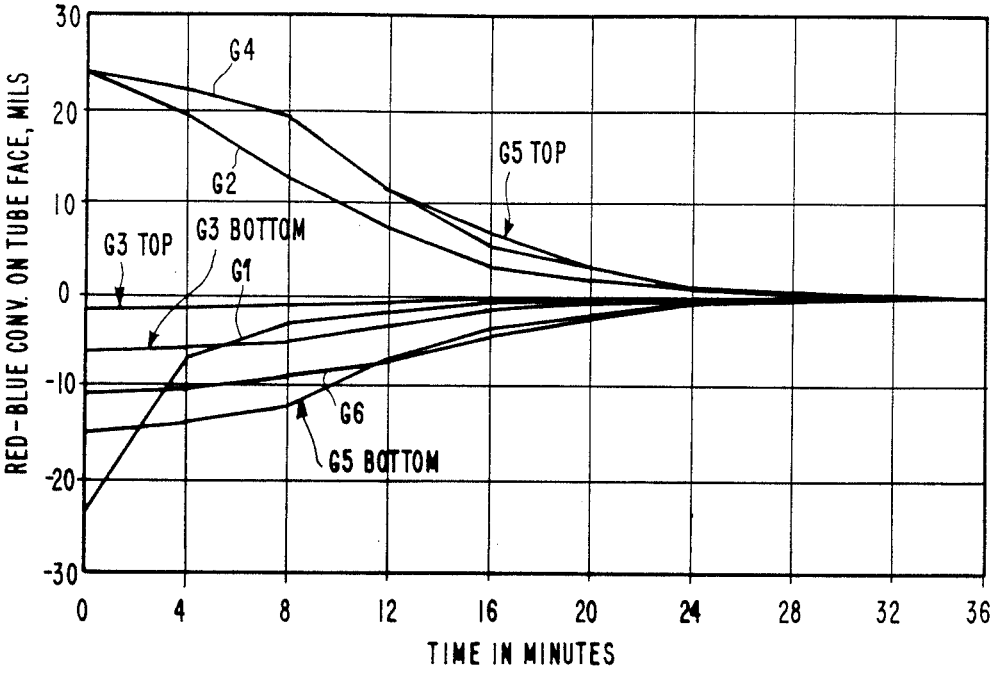
FIG. 8 is a graph, similar to the graph of FIG. 7, showing the convergence drift between two outer beams, red and blue.
Figure 9:
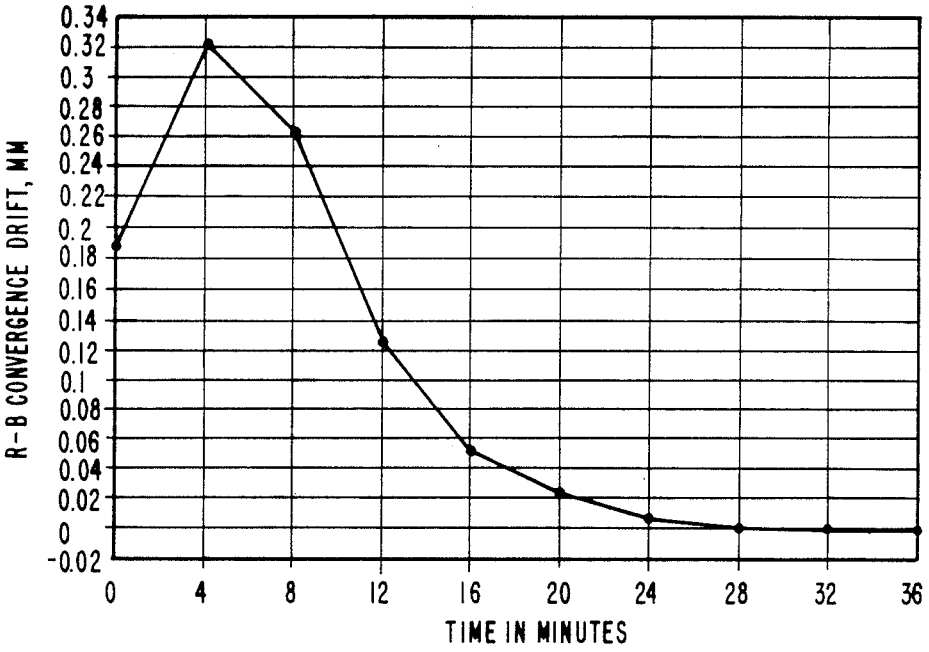
FIG. 9 is a graph showing the combined convergence drift between outer electron beams, red and blue, for all of the electron gun electrodes.

Utilizing the computer program, the horizontal positions of the outer apertures in each electrode were independently changed in 0.002 inch (0.05 mm) increments. The sensitivity of electron beam motion at the screen to this aperture motion was determined for each electrode. The beam motion at the screen caused by the expansion of each electrode during tube warmup was then determined, by translating the temperature rise of each electrode as a function of time into aperture motion based on the thermal coefficient of expansion of the electrode material. Using the transient temperature rise of each electrode during warm-up, shown in FIG. 5, and the sensitivity of beam motion on the screen to the 0.002 inch change in horizontal aperture position of each electrode, the beam motion on the screen for each electrode during warm-up was determined to be as shown in FIG. 6. By normalizing these curves to the steady-state converged beams, as shown in FIG. 7, the contribution to convergence drift of each electrode was seen. Because the two outer beams (red/blue) had equal but opposite motion during warm-up, the red-to-blue convergence drift was twice that of a single beam, as shown in FIG. 8. Summing the contribution of each electrode at specific times resulted in the theoretical red-to-blue convergence drift shown in FIG. 9.

Figure 10:
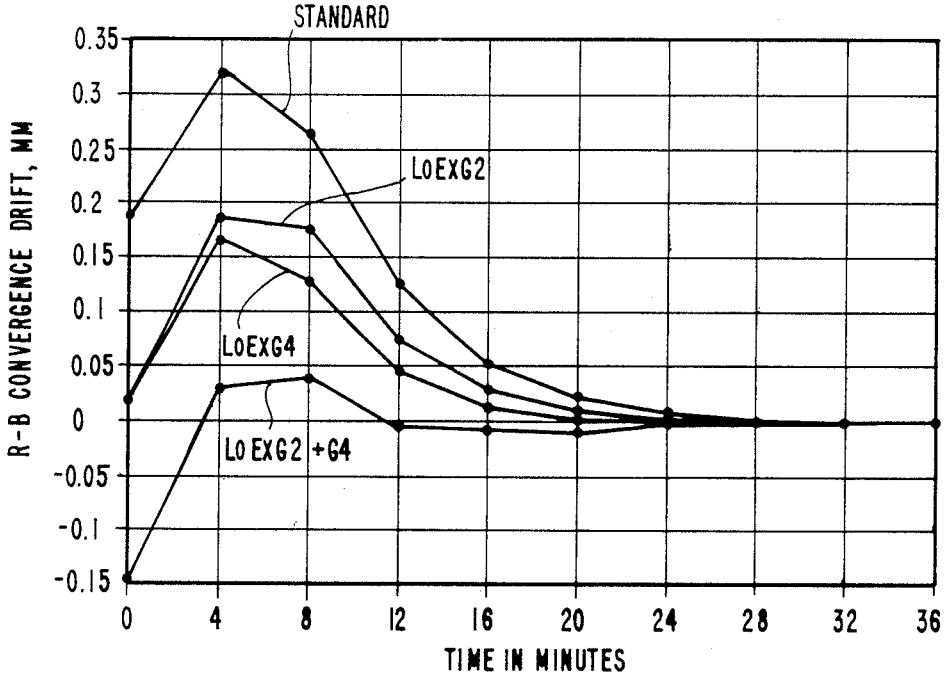
FIG. 10 is a graph of the combined convergence drift between outer electron beams in a standard unmodified electron gun, a gun with a low expansion G2 electrode, a gun with a low expansion G4 electrode and a gun with combined low expansion G2 and G4 electrodes.
Figure 11A:
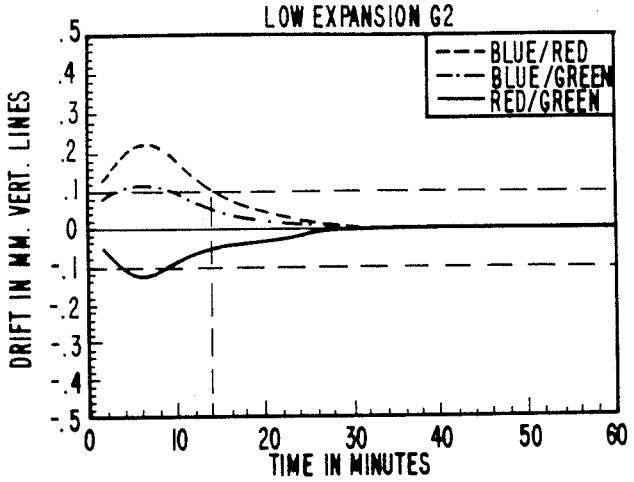
FIG. 11*a*, 11*b* and 11*c* are graphs of convergence drift curves for three different tubes having low expansion G2 electrodes.
Figure 11B:
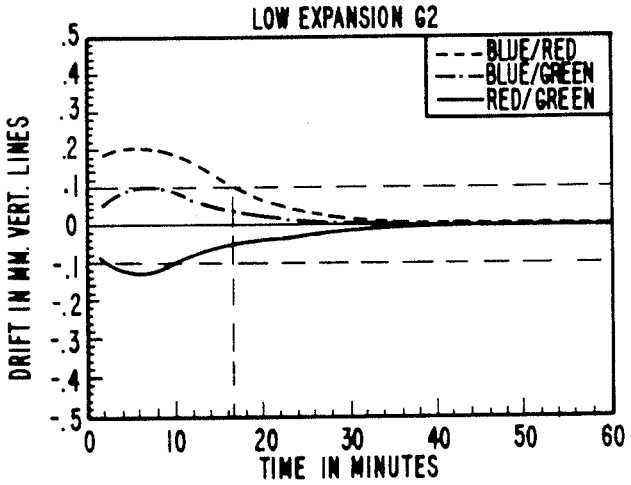
Figure 11C:
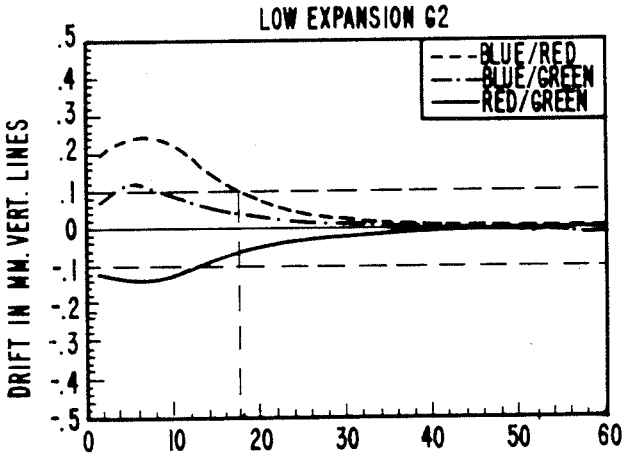
Figure 12A:
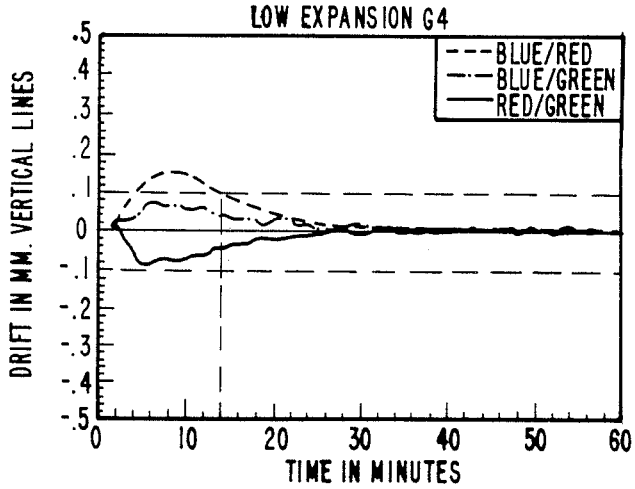
FIGS. 12*a*, 12*b* and 12*c* are graphs of convergence drift curves for three different tubes having low expansion G4 electrodes.
Figure 12B:
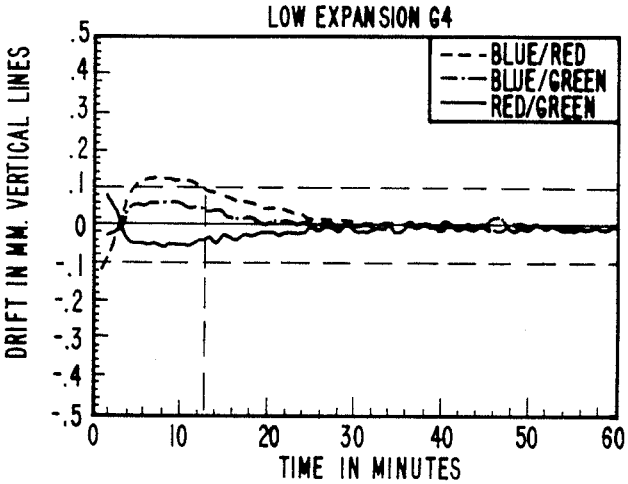
Figure 12C:
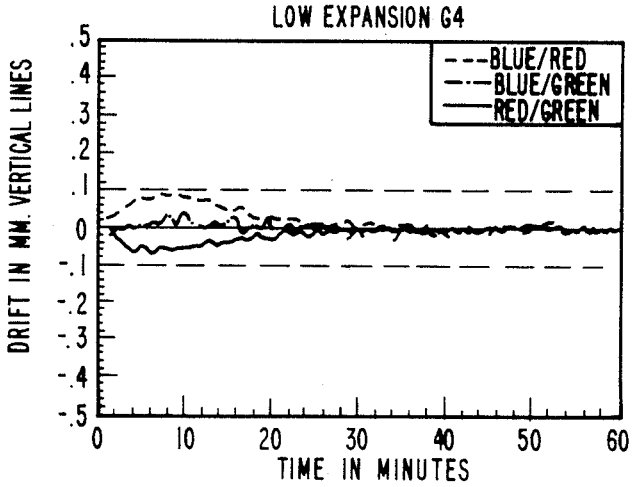
Figure 13A:
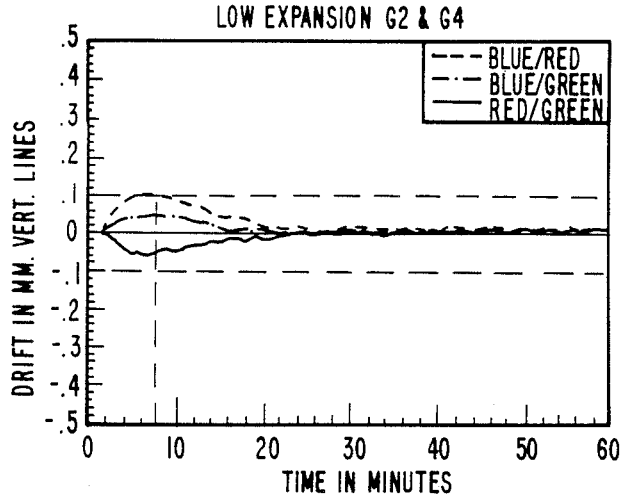
FIGS. 13*a*, 13*b* and 13*c* are graphs of convergence drift curves for three different tubes having combined low expansion G2 and G4 electrodes.
Figure 13B:
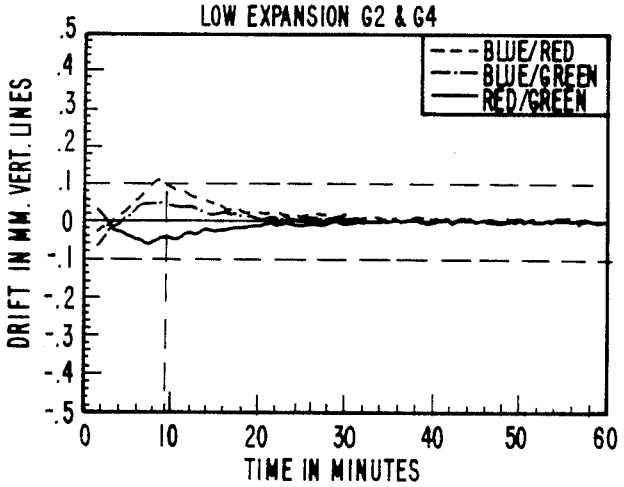
Figure 13C:
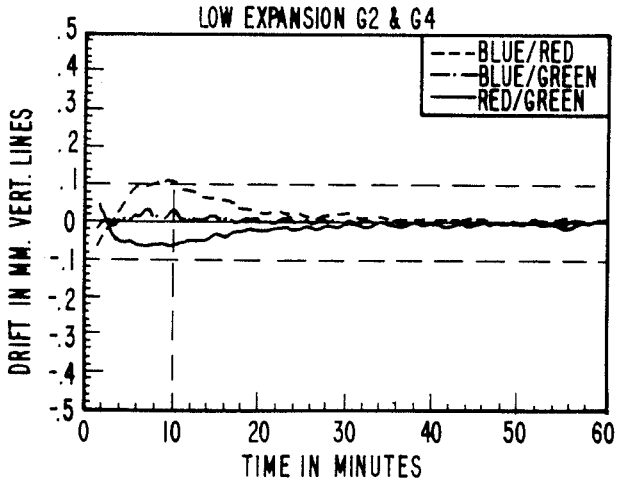

Because the net peak convergence drift was +0.32 mm (FIG. 9), convergence drift could be reduced by reducing positive beam motion components. Referring to FIG. 8, this was achieved by making the G2 and G4 electrodes of materials having lower coefficients of thermal expansion than those of the other electrode materials. The theoretical results of using only a low expansion G2, only a low expansion G4, and both a low expansion G2 and G4, as compared to a standard electron gun having all 305 stainless steel components, are shown in FIG. 10. From FIG. 10, it can be seen that the increasing order of improvement is, as expected, with the low expansion G2, then the low expansion G4, and finally the combination low expansion G2 and G4. With the combination low expansion G2 and G4, settling of the convergence drift to within 0.1 mm of the steady-state convergence value occurs within 1.5 minutes, as compared to 13 minutes for the standard electron gun.

It should be noted that convergence drift could also have been improved by using a low expansion G5 top in place of the low expansion G4 (See FIG. 8). However, this would not be desirable, because low expansion materials are usually magnetic. The G5 is located in the tube such that, if it were magnetic, it would render other components, such as external beam benders on the neck, less effective and would increase yoke drive requirements.

The bottom portion or G2-facing side of the G3 is made of a magnetically permeable material, to act as a shield to prevent penetration of the deflection fields into the beam-forming region of the electron gun. A magnetically permeable material has a lower coefficient of thermal expansion, but it is used even though the electron gun analysis indicates that a higher coefficient of thermal expansion material would be preferable from the beam convergence standpoint.

Similarly, the G1 is constructed of a low expansion material, because of its close proximity to the cathodes, even though the analysis indicate that a higher expansion material should be used. Large expansion of the G1 may cause it to warp, because it is a thin flat electrode.

Experimental Results

Figure 14:
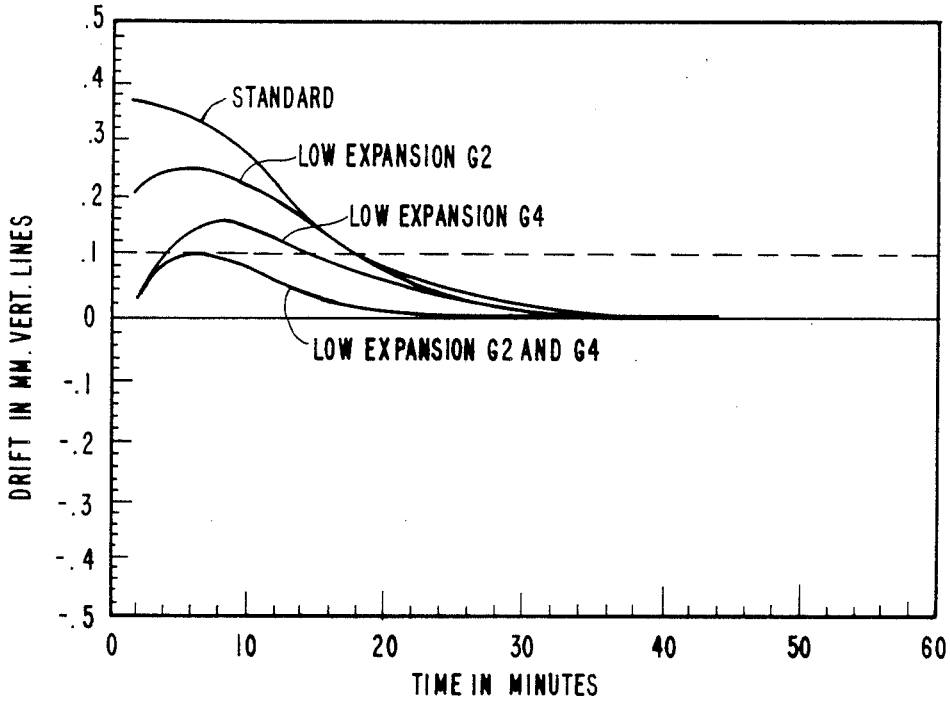
FIG. 14 is a composite graph comparing the outer-to-outer beam convergence drift in tubes having a standard unmodified gun, a gun with a low expansion G2, a gun with a low expansion G4 and a gun with combined low expansion G2 and G4 electrodes.

Based on the theoretical analysis of red-to-blue convergence drift in the electron gun, guns were fabricated having low expansion G2 electrodes, low expansion G4 electrodes, and both low expansion G2 and G4 electrodes. The convergence drift results of the configurations are shown in FIGS. 11*a-c* 12*a-c* and 13*a-c*, respectively. A comparative summary of the standard gun and the modified guns of FIGS. 11*a-c*, 12*a-c* and 13*a-c* is shown in FIGURE 14. As seen in FIG. 14, the relative convergence drift performances of the experimental tubes are the same as those calculated in the theoretical analysis for the low expansion G2 and G4 electrodes. The time to settle within 0.1 mm of the steady state convergence is less than 2 minutes, as compared to 18 minutes for the standard gun.

Although the above-described method, of determining which electrode or electrodes of an electron gun should be constructed of a material having a lower coefficient of thermal expansion, was described for an electron gun having six electrodes and particular electrical connections, the method also may be applied to other electron guns having different numbers of electrodes and having different electrical connections.

What is claimed is:

1. In a method of making a color picture tube inline electron gun, including the selection and assembly of a plurality of cathodes and a plurality of electrodes longitudinally spaced from said cathodes, the improvement comprising the additional steps of determining the amount and direction of electron beam misconvergence at the tube screen caused by the thermal expansion of each individual electrode during warmup of said electron gun, wherein a first group of said electrodes cause misconvergence of the electron beams in a first direction, and a second group of said electrodes cause misconvergence in a second direction, summing the individual contributions of the electrodes to electron beam misconvergence at the screen during electron gun warmup, wherein the net effect of thermal expansion of the entire electron gun is a misconvergence in the first direction, forming at least one of the electrodes in said first group of electrodes from a material having a lower coefficient of thermal expansion than the coefficient of thermal expansion used in the first step of determining misconvergence caused by the thermal expansion of each individual electrode.

* * * * *